US009711300B2

(12) United States Patent
Chen et al.

(10) Patent No.: US 9,711,300 B2
(45) Date of Patent: Jul. 18, 2017

(54) SWITCH AND BUTTON THEREOF

(71) Applicant: Siemens Aktiengesellschaft, München (DE)

(72) Inventors: Zhong Hui Chen, Suzhou (CN); Zhi Cheng, Suzhou (CN); Jian Ming Liu, Suzhou (CN); Shi Bo Yin, Suzhou (CN); Rudolf Zimmermann, Sulzbach-Rosenberg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/761,332

(22) PCT Filed: Feb. 22, 2013

(86) PCT No.: PCT/CN2013/071775
§ 371 (c)(1),
(2) Date: Jul. 16, 2015

(87) PCT Pub. No.: WO2014/127524
PCT Pub. Date: Aug. 28, 2014

(65) Prior Publication Data
US 2015/0357131 A1 Dec. 10, 2015

(51) Int. Cl.
*H01H 13/14* (2006.01)
*H01H 13/66* (2006.01)
*H01H 13/20* (2006.01)

(52) U.S. Cl.
CPC ..... *H01H 13/14* (2013.01); *H01H 13/20* (2013.01); *H01H 13/66* (2013.01); *H01H 2221/044* (2013.01)

(58) Field of Classification Search
CPC .. H01H 3/00; H01H 3/12; H01H 3/02; H01H 3/14; H01H 13/14; H01H 13/00;
(Continued)

(56) References Cited

U.S. PATENT DOCUMENTS 2,671,140 A 3/1954 Schellman et al.
4,188,518 A 2/1980 du Temple de Rougemont
(Continued)

FOREIGN PATENT DOCUMENTS

CN 2149680 Y 12/1993
CN 2768175 Y 3/2006
GB 753678 A 7/1956

OTHER PUBLICATIONS

International Search Report PCT/ISA/210 for International Application No. PCT/CN2013/071775 dated Sep. 6, 2013.
(Continued)

*Primary Examiner* — Anthony R. Jimenez
(74) *Attorney, Agent, or Firm* — Harness, Dickey & Pierce, P.L.C.

(57) ABSTRACT

A button includes a housing, an operating portion, a mount, a first pushing rod, a bridge, an elastic member, and a second pushing rod. The mount is mounted in the housing. The first pushing rod is movably disposed in the mount. A bump is formed on the first pushing rod. The bridge and the operating portion are disposed on ends of the first pushing rod. The second pushing rod is movably disposed on the bridge and is effected by the elastic member. A step is formed in the housing and is located between the mount and the bridge. The elastic member is disposed on the first pushing rod and is located between the bump and the step. The first pushing rod is slidable relative to the mount under the effect of the operating portion or the elastic member, and drives the bridge and/or the second pushing rod to move.

6 Claims, 3 Drawing Sheets

(58) Field of Classification Search
CPC .... H01H 13/20; H01H 13/50; H01H 2003/00; H01H 2003/12; H01H 13/66; H01H 2221/044
USPC .... 200/520, 243, 519, 307, 340, 16 A, 16 B, 200/409, 453, 458, 459, 466, 467, 200/537–539, 303, 329, 341, 345
See application file for complete search history.

(56) References Cited

U.S. PATENT DOCUMENTS 4,250,368 A 2/1981 Johnston et al.
4,282,414 A 8/1981 Johnston et al.

OTHER PUBLICATIONS

Written Opinion of the International Searching Authority PCT/ISA/237 for International Application No. PCT/CN2013/071775 dated Sep. 6, 2013.

SWITCH AND BUTTON THEREOF

PRIORITY STATEMENT

This application is the national phase under 35 U.S.C. §371 of PCT International Application No. PCT/CN2013/071775 which has an International filing date of Feb. 22, 2013, which designated the United States of America, the entire contents of which are hereby incorporated herein by reference.

FIELD

An example embodiment of the present invention generally relates to a switch and a button thereof.

BACKGROUND

In certain electronically controlled switch scenarios, a switch must be manipulated in order to change the state of contacts. Switches in the prior art generally comprise a button and a three-position contact module, wherein the button is used to control the three-position contact module in order to change the state of the contacts, e.g. a similar structure is disclosed in U.S. Pat. No. 4,282,414. However, the structure of the three-position contact module is rather complex, with poor stability and high costs.

Furthermore, since an ordinary two-position contact module only has two states (on and off), an existing button cannot achieve three-position on/off switching if an ordinary two-position contact module is used.

SUMMARY

An example embodiment of the present invention provides a button which can be used to control a two-position contact module to achieve three-position on/off switching. An example embodiment is directed to a switch which uses the button.

According to an embodiment, a button is provided, comprising a housing, an operating portion, a mount, a first pushing rod, a bridge, an elastic member and a second pushing rod; the mount is mounted in the housing. The first pushing rod is movably disposed in the mount. A projection is formed on the first pushing rod. The bridge and the operating portion are disposed on two ends of the first pushing rod. The second pushing rod is movably disposed on the bridge and is acted upon by the elastic member. A step is formed in the housing. The step is located between the mount and the bridge. The elastic member is disposed on the first pushing rod and is located between the projection and the step. The first pushing rod can slide relative to the mount under the action of the operating portion or the elastic member, and drive the bridge and/or the second pushing rod to move.

In one embodiment, the elastic member is a spring surrounding the first pushing rod.

In one embodiment, the button further comprises a spacer; the spacer surrounds the first pushing rod and is sandwiched between the elastic member and the step.

In one embodiment, the bridge comprises a body, a sidewall and a gap; the first pushing rod is connected to the body; the sidewall is disposed on the body; the gap is formed in the sidewall and the body; two recessed portions are formed on an inner surface of the sidewall and located on two sides of the gap; the second pushing rod comprises a base body and two extension arms; the base body is located in the gap of the bridge and in contact with the spacer; the two extension arms are disposed on two sides of the base body, located inside the bridge and respectively in contact with the two recessed portions.

In one embodiment, the sidewall is arcuate; the two extension arms are arcuate.

In one embodiment, the bridge further comprises two extending portions; the two extending portions are disposed perpendicularly on the body; a guiding structure is formed on an outer surface of each of the two extending portions.

In one embodiment, the housing comprises a first tube portion and a second tube portion; the diameter of the first tube portion is larger than the diameter of the second tube portion; the operating portion and the mount are located in the first tube portion; the second tube portion is in communication with the first tube portion; the bridge, the elastic member and the second pushing rod are located in the second tube portion; the step is formed in the second tube portion.

In one embodiment, a fixing portion is provided on an inner surface of the first tube portion; the mount is mounted in the first tube portion by means of the fixing portion.

According to another embodiment of the present invention, a switch is provided, comprising a generic two-position contact module; the generic two-position contact module comprises a normally-open contact and a normally-closed contact; the switch also comprises the button described above; the first pushing rod of the button drives the bridge of the button to move in order to control the on/off switching of the normally-open contact; movement of the second pushing rod of the button controls the on/off switching of the normally-closed contact.

In one embodiment of the invention, the button has an equilibrium position. When the button is in the equilibrium position, the second pushing rod is in contact with the bridge, and the second pushing rod triggers the disconnection of the normally-closed contact under the action of the elastic member of the button. The normally-open contact is in a disconnected state. The button is pressed so that the first pushing rod slides towards the generic two-position contact module, and so that the elastic member is compressed. The bridge moves with the first pushing rod until the bridge triggers the connection of the normally-open contact. The second pushing rod is supported by the normally-closed contact and so does not move.

When the button is released, the button returns to the equilibrium position, under the action of the restoring elastic force of the elastic member. Pulling the button up from the equilibrium position causes the first pushing rod to move in a direction away from the generic two-position contact module, and the elastic member to be compressed. The bridge drives the second pushing rod to move together with the bridge in the direction away from the generic two-position contact module, until the second pushing rod triggers through the connection of the normally-closed contact.

The button in an embodiment of the present invention and the switch which uses the button can use the first pushing rod to drive the bridge to move so as to control the on/off switching of the normally-open contact of the generic two-position contact module, and use the second pushing rod mounted on the bridge to control the on/off switching of the normally-closed contact of the generic two-position contact module, thereby achieving three-position on/off switching. Compared to a three-position contact module, the generic two-position contact module has a simple structure, and cost body, while mounting and replacement are convenient. Thus, when the switch of the button in an embodiment of the present invention is used, a generic two-position contact module with a lower cost can be used to achieve three-position on/off switching, with lower costs and convenient mounting and replacement.

The explanation above is merely an overview of the technical solution of embodiments of the present invention. In order to enable a clearer understanding of the technical approaches of embodiments of the present invention, and enable implementation according to the content of the description, and also to make the above and other objects, features and advantages of the embodiments of the present invention more obvious and easier to understand, example embodiments are explained in detail below in conjunction with the accompanying drawings.

Figure 1:
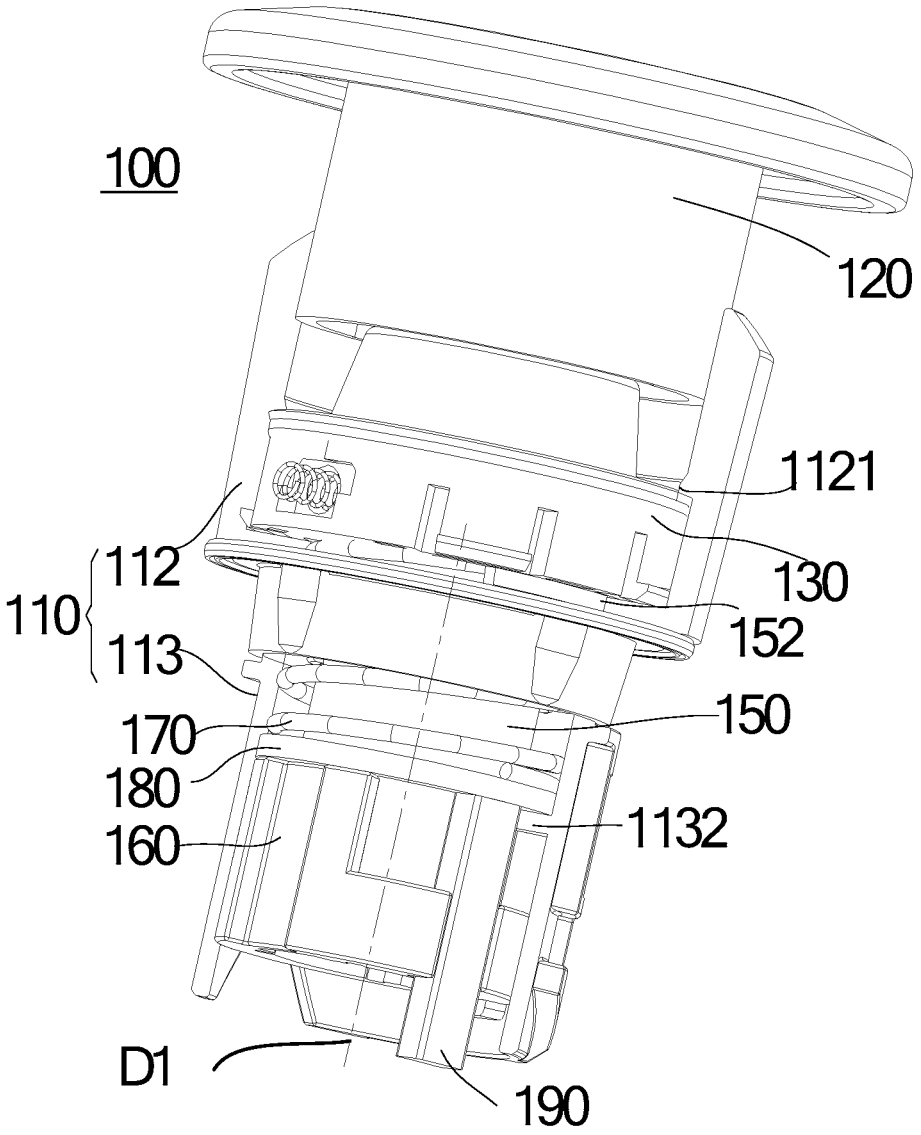
FIG. 1 is a schematic diagram of a button in an embodiment of the present invention.

110 housing
112 first tube portion
1121 fixing portion
113 second tube portion
1132 step
120 operating portion
130 mount
150 first pushing rod
152 projection
160 bridge
162 body
163 extending portion
164 guiding structure
165 sidewall
166 gap
167 recessed portion
170 elastic member
180 compression spacer
190 second pushing rod
192 base body
193 extension arm
D1 axial direction

DETAILED DESCRIPTION OF EXAMPLE EMBODIMENTS

In order to clarify the technical problem to be solved by embodiments of the present invention, as well as the technical solution and beneficial effects thereof, embodiments of the present invention are explained in further detail below in conjunction with the accompanying drawings and example embodiments. It should be understood that the particular embodiments described here are intended merely to explain the present invention, not to limit it.

FIG. 1 shows a schematic diagram of a button 100 in an embodiment of the present invention. As FIG. 1 shows, the button 100 comprises a housing 110, an operating portion 120, a mount 130, a first pushing rod 150, a bridge 160, an elastic member 170, a spacer 180 and a second pushing rod 190. The mount 130 is mounted in the housing 110; the first pushing rod 150 is movably disposed in the mount 130; the bridge 160 is disposed on the first pushing rod 150; the second pushing rod 190 is movably disposed on the bridge 160; the elastic member 170 and spacer 180 are disposed on the first pushing rod 150 and are located between the mount 130 and the bridge 160; the first pushing rod 150 can slide relative to the mount 130 under the action of the operating portion 120 or elastic member 170, and drive the bridge 160 and/or second pushing rod 190 to move.

Specifically, the housing 110 is substantially tubular, comprising a first tube portion 112 and a second tube portion 113. The diameter of the first tube portion 112 is larger than the diameter of the second tube portion 113. The first tube portion 112 may be used to accommodate the operating portion 120 and mount 130. In one embodiment, a fixing portion 1121 is provided on an inner surface of the first tube portion 112, for mounting the mount 130 in the first tube portion 112. The second tube portion 113 is in communication with the first tube portion 112, and may be used to accommodate the first pushing rod 150, bridge 160, elastic member 170, spacer 180 and second pushing rod 190. In one embodiment, a step 1132 is provided on an inner surface of the second tube portion 113, for defining the position of the spacer 180.

The first pushing rod 150 is disposed in the housing 110 and movably disposed in the mount 130. The first pushing rod 150 extends substantially in an axial direction D1 of the housing 110. The first pushing rod 150 comprises a first end and a second end. A first end of the first pushing rod 150 is located in the first tube portion 112, and connected to the operating portion 120; thus, the operating portion 120 can drive the first pushing rod 150 to slide in the housing 110 relative to the mount 130 in the axial direction D1. A second end of the first pushing rod 150 is located in the second tube portion 113. In one embodiment, a projection 152 in contact with an upper part of the elastic member 170 (when the button 100 is in the position shown in FIG. 1) can be provided on the first pushing rod 150, for applying an acting force to the elastic member 170.

Figure 2:
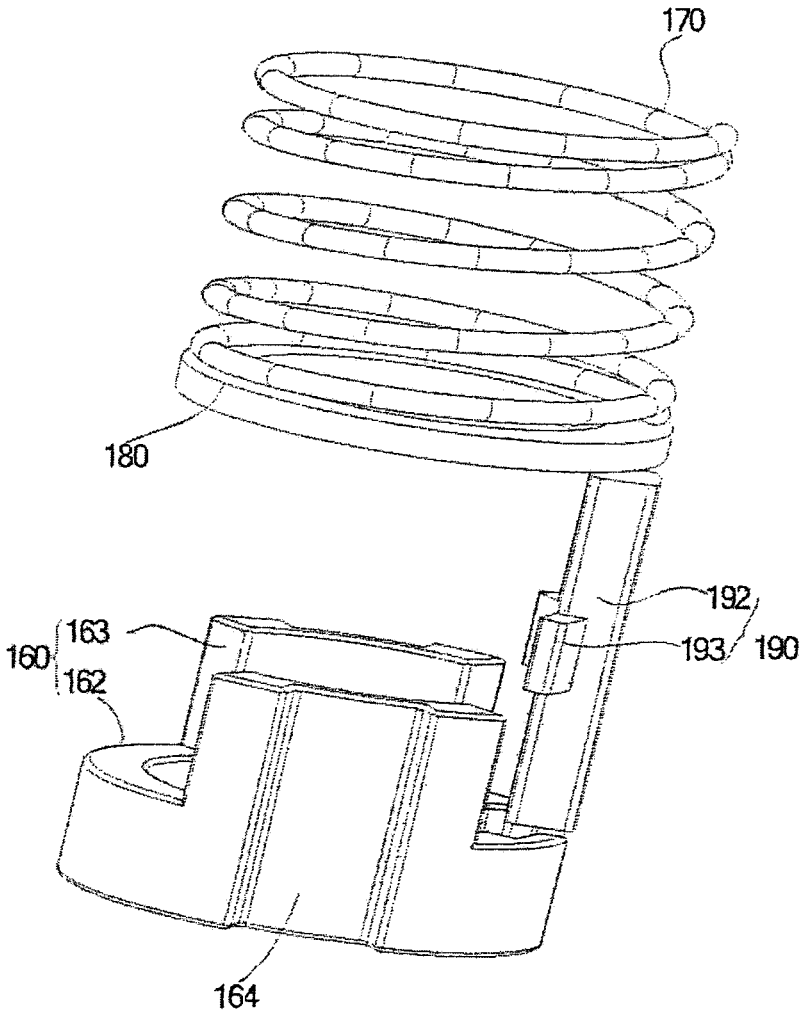
FIG. 2 is a magnified schematic diagram of some components of the button in FIG. 1.
Figure 3:
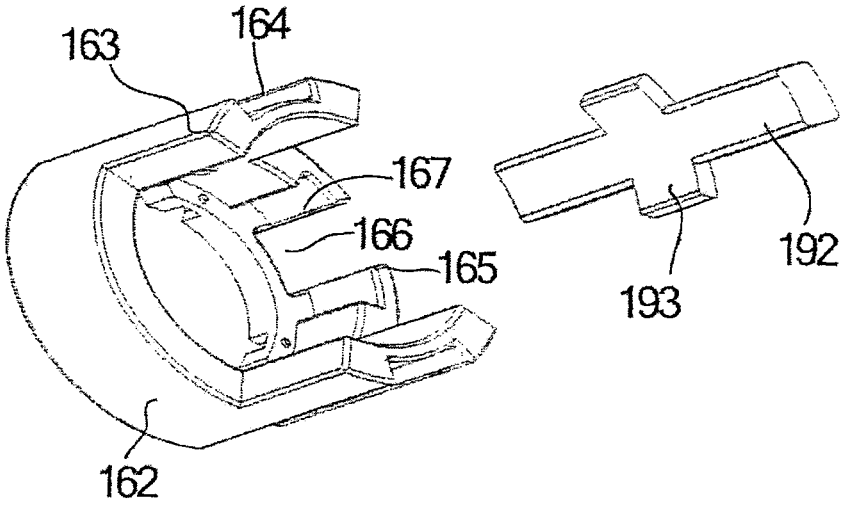
FIG. 3 is a schematic diagram of the bridge and second pushing rod in FIG. 2.

The bridge 160 is disposed on the second end of the first pushing rod 150 and is located in the second tube portion 113. The bridge 160 can move together with the first pushing rod 150. In one embodiment, as shown in FIGS. 2 and 3, the bridge 160 comprises a body 162, two extending portions 163 and a sidewall 165. The body 162 is substantially annular. It may be used for mounting the first pushing rod 150, and it may be used for triggering the connection of a normally-open contact in a two-position contact module. The two extending portions 163 are disposed on the body 162 in a substantially perpendicular manner, and can serve a guiding function.

A guiding structure 164 such as a groove (as shown in FIG. 3) or a protrusion may be formed on an outer surface of the extending portion 163; in this case, a protrusion or groove may be correspondingly disposed on an inner surface of the second tube portion 113, in order to guide the sliding of the bridge 160 in the second tube portion 113. The sidewall 165 is disposed on the body 110 in a substantially perpendicular manner and is located between the two extending portions 163. In one embodiment, the sidewall 165 is arranged along a periphery of the body 110 and is arcuate. A gap 166 is formed in the sidewall 165 and body 110; two recessed portions 167 are formed on an inner surface of the sidewall 165 and located on two sides of the gap 166, so that parts of the sidewall 165 which are close to the gap 166 become a thin-walled structure to mount the second pushing rod 190.

The elastic member 170 and spacer 180 are disposed on the first pushing rod 150 and located between the mount 130 and the step 1132 of the second tube portion 113. In one embodiment, the elastic member 170 is a spring which surrounds the first pushing rod 150; one end of the elastic member 170 is in contact with the projection 152 on the first pushing rod 150, while the other end is in contact with the spacer 180. The spacer 180 surrounds the first pushing rod 150 and is sandwiched between the elastic member 170 and the step 1132 of the second tube portion 113.

As FIGS. 2 and 3 show, the second pushing rod 190 comprises a base body 192 and two extension arms 193. The base body 192 is substantially rod-shaped, and can be disposed in the gap 166 of the bridge 160. The two extension arms 193 are disposed on two sides of the base body 192, and are disposed to correspond to the two recessed portions 167 on the bridge 160. When the base body 192 is located in the gap 166 of the bridge 160, the two extension arms 193 are located inside the bridge 160 and are respectively in contact with the two recessed portions 167, so that the second pushing rod 190 is slidably disposed on the bridge 160. In one embodiment, the two extension arms 193 are arcuate.

Described above is a particular structure of the button 100 in an embodiment of the present invention. A method of using the button 100 is explained briefly below, taking as an example the use of the button 100 to control a generic two-position contact module (i.e. the button 100 and the generic two-position contact module form a switch) to achieve three-position on/off switching.

The generic two-position contact module comprises a normally-open contact and a normally-closed contact.

When the button 100 is in the position shown in FIG. 1, the button 100 is in an equilibrium position; at this time, a lower part of the second pushing rod 190 is in contact with the body 162 of the bridge 160, while an upper part of the second pushing rod 190 is acted upon by the elastic member 170 and the spacer 180 and is thereby held in the position shown in FIG. 1. When the button 100 in the equilibrium position is used for the generic two-position contact module, a bottom end or free end of the second pushing rod 190 can be made to trigger the disconnection of the normally-closed contact of the two-position contact module, i.e. both the normally-open contact and the normally-closed contact of the generic two-position contact module are in a disconnected state.

The button 100 is pressed so that the first pushing rod 150 slides in the mount 130 towards the generic two-position contact module in the direction from the first tube portion 112 to the second tube portion 113; at the same time, the bridge 160 also slides in the second tube portion 113 until the bridge 160 triggers the connection of the normally-open contact of the generic two-position contact module.

During this process, the projection 152 on the first pushing rod 150 compresses the elastic member 170; since the bottom end or free end of the second pushing rod 190 is supported by the normally-closed contact of the generic two-position contact module (the normally-closed contact may have a spring structure, wherein the elastic force of the spring can support the second pushing rod 190) and so cannot move, the normally-closed contact of the generic two-position contact module remains in a disconnected state, whereas the normally-open contact of the generic two-position contact module is in a connected state. When the button 100 is released, the first pushing rod 150 and bridge 160 return to the position shown in FIG. 1, under the action of the restoring elastic force of the elastic member 170.

When the button 100 is pulled up from the equilibrium position shown in FIG. 1, the first pushing rod 150 moves in the mount 130 in the direction from the second tube portion 113 to the first tube portion 112; during this process, the elastic member 170 is compressed, and the bridge 160 can drive the second pushing rod 190 to move together with the bridge away from the generic two-position contact module in the direction from the second tube portion 113 to the first tube portion 112, until connection of the normally-closed contact of the generic two-position contact module is triggered. At this time, the normally-closed contact of the generic two-position contact module is in a connected state, whereas the normally-open contact of the generic two-position contact module is in a disconnected state.

As described above, the button 100 in an embodiment of the present invention can use the first pushing rod 150 to drive the bridge 160 to move so as to control the on/off switching of the normally-open contact of the generic two-position contact module, and use the second pushing rod 190 mounted on the bridge 160 to control the on/off switching of the normally-closed contact of the generic two-position contact module, thereby achieving three-position on/off switching. Compared to a three-position contact module, the generic two-position contact module has a simple structure, and cost body, while mounting and replacement are convenient. Thus, when the switch of the button 100 in an embodiment of the present invention is used, a generic two-position contact module with a lower cost can be used to achieve three-position on/off switching, with lower costs and convenient mounting and replacement.

In summary, an embodiment of the present invention discloses a button, comprising a housing, an operating portion, a mount, a first pushing rod, a bridge, an elastic member and a second pushing rod; the mount is mounted in the housing; the first pushing rod is movably disposed in the mount; a projection is formed on the first pushing rod; the bridge and the operating portion are disposed on two ends of the first pushing rod; the second pushing rod is movably disposed on the bridge and is acted upon by the elastic member; a step is formed in the housing; the step is located between the mount and the bridge; the elastic member is disposed on the first pushing rod and is located between the projection and the step; the first pushing rod can slide relative to the mount under the action of the operating portion or the elastic member, and drive the bridge and/or the second pushing rod to move.

The above embodiments are merely example embodiments of the present invention, which are not intended to limit it. Any amendments, equivalent substitutions and improvements etc. which are made within the spirit and principles of the present invention should be included in the scope of protection thereof.

The invention claimed is:

1. A button, comprising:

a housing;

a mount, mounted in the housing;

a first pushing rod, movably disposed in the mount, a projection being formed on the first pushing rod;

a bridge comprising a body and a sidewall, the first pushing rod being connected to the body, the sidewall being disposed on the body, a gap being formed in the sidewall and the body of the bridge, two recessed portions being formed on an inner surface of the sidewall and located on two sides of the gap;

an elastic member;

a spacer surrounding the first pushing rod;

a second pushing rod, movably disposed on the bridge and movable by the elastic member, wherein the second pushing rod comprises a base body and two extension arms, the base body being located in the gap of the bridge and in contact with the spacer, and the two extension arms being disposed on two sides of the base body, located inside the bridge and respectively in contact with the two recessed portions; and an operating portion, the bridge being disposed on one end of the first pushing rod and the operating portion being disposed on another end of the first pushing rod, wherein a step is formed in the housing, located between the mount and the bridge, the elastic member being disposed on the first pushing rod and being located between the projection and the step, and wherein the first pushing rod is slideable relative to the mount under action of the operating portion or the elastic member, and is configured to drive at least one of the bridge and the second pushing rod to move, and wherein the spacer is between the elastic member and the step.

2. The button of claim 1, wherein the elastic member is a spring surrounding the first pushing rod.

3. The button of claim 1, wherein the sidewall is arcuate and the two extension arms are arcuate.

4. The button of claim 1, wherein the bridge further comprises two extending portions, the two extending portions being disposed perpendicularly on the body and a guiding structure being formed on an outer surface of each of the two extending portions.

5. A button, comprising:

a housing;

a mount, mounted in the housing;

a first pushing rod, movably disposed in the mount, a projection being formed on the first pushing rod;

a bridge;

an elastic member;

a second pushing rod, movably disposed on the bridge and movable by the elastic member; and an operating portion, the bridge and the operating portion being disposed on two ends of the first pushing rod, wherein a step is formed in the housing, located between the mount and the bridge, the elastic member being disposed on the first pushing rod and being located between the projection and the step, and wherein the first pushing rod is slideable relative to the mount under action of the operating portion or the elastic member, and is configured to drive at least one of the bridge and the second pushing rod to move, and wherein the housing comprises a first tube portion and a second tube portion; a diameter of the first tube portion is larger than a diameter of the second tube portion; the operating portion and the mount are located in the first tube portion; the second tube portion is in communication with the first tube portion; the bridge, the elastic member and the second pushing rod are located in the second tube portion; and the step is formed in the second tube portion.

6. The button of claim 5, wherein a fixing portion is provided on an inner surface of the first tube portion; and the mount is mounted in the first tube portion via the fixing portion.

* * * * *